United States Patent [19]

Peters, Jr. et al.

[11] 4,147,087

[45] Apr. 3, 1979

[54] PITCH CHANGE LIMITING DEVICE IN CONJUNCTION WITH STRINGED MUSICAL INSTRUMENTS

[76] Inventors: Joseph Peters, Jr., 2509 179th St., Torrance, Calif. 90504; Brian P. Feeney, 11820 Woodbine Ave., Los Angeles, Calif. 90066

[21] Appl. No.: 806,093

[22] Filed: Jun. 13, 1977

[51] Int. Cl.[2] ..... G10D 3/14

[52] U.S. Cl. ..... 84/312 R; 84/304

[58] Field of Search ..... 84/304, 312 R, 454, 84/455, 305

[56] References Cited

U.S. PATENT DOCUMENTS 3,674,909 7/1972 Peters ..... 84/304

FOREIGN PATENT DOCUMENTS 371 10/1899 Austria ..... 84/305

OTHER PUBLICATIONS

Music Catalog, C. Bruno & Son Inc., Cat. No. 96, 1965, Geared Pegs, No. 2723, p. 88.

Music Catalog, David Wexler & Co., Cat. No. 66, 1966, Geared Pegs, No. 1711, p. 136.

*Primary Examiner*—L. T. Hix
*Assistant Examiner*—S. D. Schreyer
*Attorney, Agent, or Firm*—Romney, Schaap, Golant, Scillieri, Disner & Ashen

[57] ABSTRACT

An adapter system for a stringed musical instrument having a tuning key and a string connected to the tuning key for adjusting the pitch of sound rendered by striking the string attached to said key. A limit stop is operatively mounted on the instrument along with a,rotational stop mounted on the key for interacting with the limit stop to confine the rotational movement of the tuning key to a certain predetermined arc. The limit stop can be adjusted to selectively change the angular arc. An internal adapter cylinder is operatively mounted on the shaft of the tuning key where the tuning key shaft is of a non-circular configuration. An upper cylinder and a lower cylinder are operatively mounted with respect to the internal adapter cylinder. The adapter cylinder is provided with a recess which accommodates a cylindrical insert used when the tuning key is not provided with a shoulder portion.

2 Claims, 13 Drawing Figures

PITCH CHANGE LIMITING DEVICE IN CONJUNCTION WITH STRINGED MUSICAL INSTRUMENTS

BACKGROUND OF THE INVENTION

1. Field of the Invention

This invention relates in general to certain new and useful improvements in changing the degree of pitch in stringed musical instruments, and, more particularly, to devices which may be either adapted to or incorporated in stringed musical instruments for changing the degree of pitch by means of limiting the rotational movement of keys which operate the strings on the stringed musical instrument.

2. Description of the Prior Art

In playing a stringed musical instrument it is desirable to be able to change the pitch of a particular string, making it either higher or lower, while playing the instrument. Thus, if a particular string is plucked, and then the pitch is raised by increasing the tension on the string, a whining or sliding effect is produced. The same effect can be produced when lowering the pitch by decreasing the string tension.

There have been some attempts to produce a device which would accomplish the foregoing results, for example, as disclosed in U.S. Pat. Nos. 2,644,360 and 3,000,253. These devices provide a means in addition to the standard tuning peg for altering the tension in a string and thereby changing its pitch. While these devices accomplish the desired result, they are unsightly, unwieldy, and require the addition of a complicated mechanism to the instrument. Even moreso, these devices have not been truly effective in changing the pitch of a string on a particular stringed musical instrument with respect to the change of pitch on another string of the same music instrument.

In addition to the foregoing, there has been proposed a device for changing the pitch of stringed musical instruments in accordance with U.S. Pat. No. 3,674,909, dated July 4, 1972. This latter patent provides for an assembly used with the tuning key of a stringed musical instrument in order to accomplish the foregoing results in conjunction with a limit stop means. However, this assembly was not particularly effective in being adaptable with musical instruments which have circular tuning key shafts as well as instruments having tuning key shafts which are non-circular in cross section. In addition, the assembly in this latter patent does not necessarily provide for means to rigidly secure the limit stop means to the instrument in order to prevent unauthorized turning of the limit stop means which thereby interferred with proper pitch adjustment of the strings in the stringed musical instrument. Moreover, this latter assembly did not provide means for use with tuning key pegs having a shoulder portion thereon and tuning key pegs which did not have a shoulder portion thereon.

OBJECTS OF THE INVENTION

It is, therefore, the primary object of the present invention to provide an improvement to playing stringed musical instruments having tuning keys adjusting the degree of tension on a musical playing string and which improvement can be used on a wide variety of musical instruments having different shaped tuning key pegs.

It is also an object of the present invention to provide an improvement of the type stated to obtain proper tuning of one of the strings of the musical instrument with respect to another of the strings on the musical instrument without affecting a predetermined setting of the instrument.

It is another object of the present invention to provide a device of the type stated which enables a change of pitch of particular strings on the musical instrument between predetermined notes during the playing of the musical instruments which permits the production of sliding or whining musical effects.

It is a further object of the present invention to provide a device of the type stated which provides the user of the device with a means of readily changing the tuning of a stringed musical instrument by rotating the tuning keys until proper limits established by the device are obtained.

It is an additional object of the present invention to provide a stringed musical instrument of the type stated which includes a means forming a part thereof which permits the player of the instrument to change the pitch of a particular string of the instrument by turning the tuning key associated with such string within predetermined limits.

It is yet a further object of the present invention to provide a device of the type stated which can be readily installed on the tuning peg of a stringed musical instrument which is simple to operate and economical to manufacture.

It is yet another object of the present invention to provide a device which is capable of limiting the rotational movement of a musical instrument tuning key shaft to a predetermined angular value and which also permits adaptation for tuning key shafts having circular shapes or non-circular shapes.

It is another salient object of the present invention to provide a method of tuning a stringed musical instrument by adjusting the tension on the strings of the musical instrument within certain preestablished ranges.

With the above and other objects in view, our invention resides in the novel features of form, construction, arrangement and combination of parts presently described and pointed out in the claims.

SUMMARY OF THE INVENTION

The present invention provides a simple device that is readily attachable to the tuning key shaft of a stringed musical instrument. This invention provides a device whereby the user is able to change the pitch of a particular string between predetermined notes while playing the instrument. This makes possible the production of sliding or whining musical effects. The device also provides the user with a means of readily changing the tuning of a stringed musical instrument. For example, when a device is employed on each of the string tuning keys, the tuning can be changed from G to D by rotating the tuning keys until the proper limit stop is contacted.

The invention is so constructed that the range of pitch change can be determined and set by the user. Once the range is set, the string can be tuned to the correct pitch with respect to the other strings of the instrument without affecting the range of pitch change set by the player. The device can be readily installed on the tuning peg of a stringed musical instrument in such manner that it is simple to operate.

In accordance with this invention, an assembly is provided for limiting the rotational motion of a musical instrument tuning key shaft to a predetermined angular value and comprises an adapter cylinder rigidly mounted on the tuning key shaft, an upper ring rotatably mounted on the adapter cylinder, a lower ring rotatably mounted on the upper ring, and a limit stop rigidly mounted on the instrument head.

The adapter cylinder provides an axis for rotation of the upper ring in the event the tuning key shaft is not circular and does not provide a suitable axis for rotation. If the tuning key shaft is circular and does provide a suitable axis for rotation, the adapter cylinder is not necessary, and the upper ring may be mounted directly on the tuning key shaft. The upper ring is rotatably mounted on the adapter cylinder and is provided with a thumb screw for the purpose of locking it to the adapter cylinder. The upper ring thumb screw also serves to contact the limit stop and prevent further rotation of the tuning key shaft. The lower ring is rotatably mounted on the upper ring, and is provided with a thumb screw for the purpose of locking the lower ring to the upper ring. The lower ring thumb screw also acts to contact the limit stop and prevent further rotation of the tuning key shaft.

The adapter cylinder is also provided with an insert so that the adapter cylinder can be used with tuning pegs which do not have a neck portion thereon. By removal of the insert, it is thereupon possible to use the adapter cylinder with tuning pegs which do include a neck portion thereon.

BRIEF DESCRIPTION OF THE DRAWINGS

Figure 1:
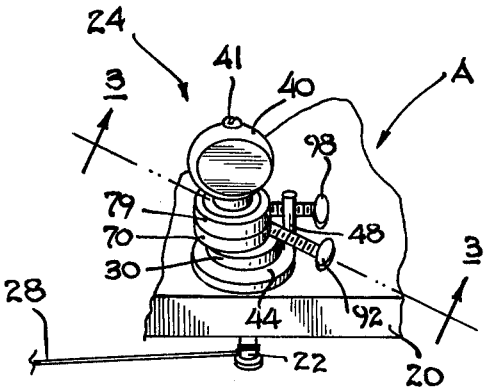
Figure 2:
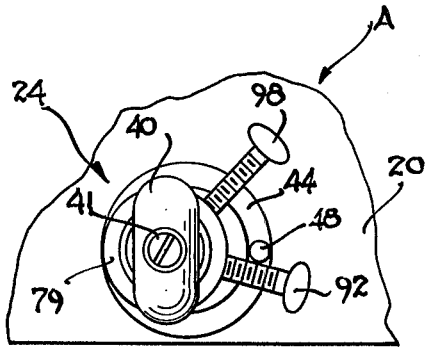
Figure 3:
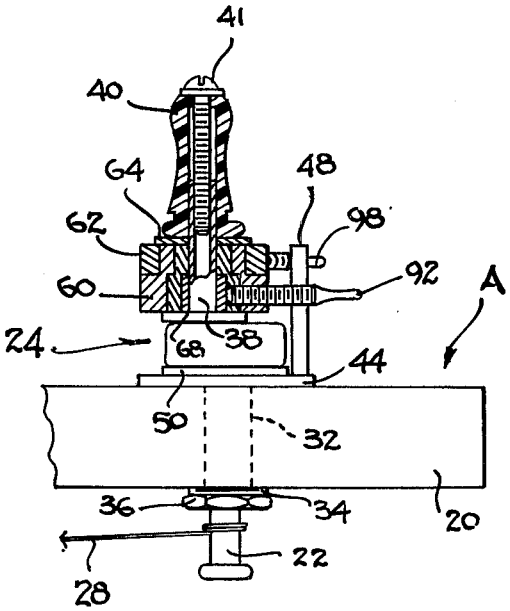
Figure 4:
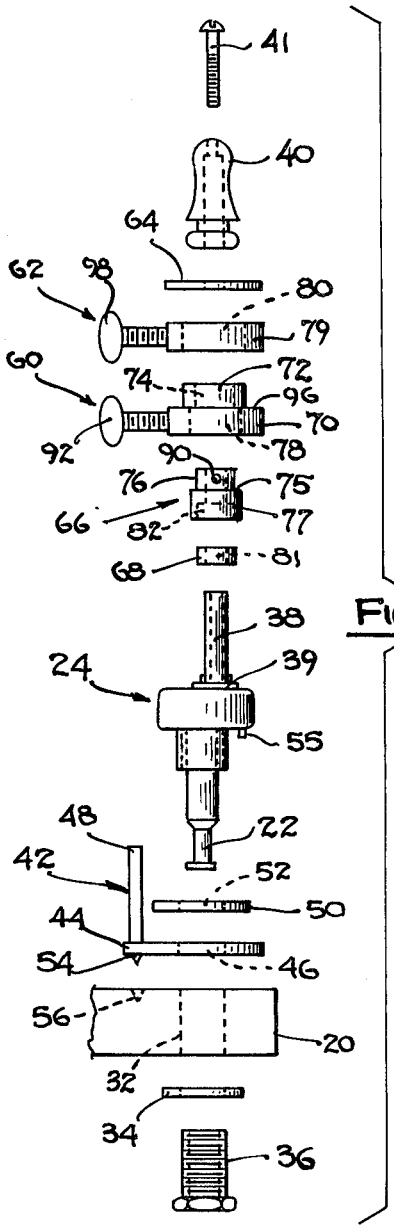
Figure 5:
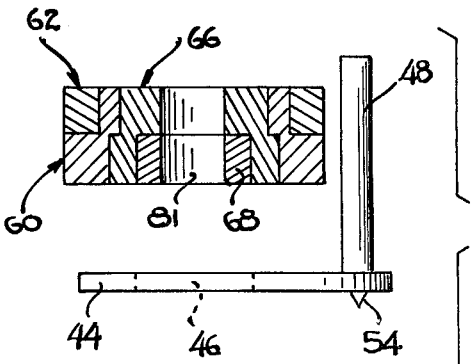
Figure 6:
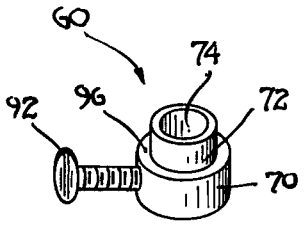
Figure 11:
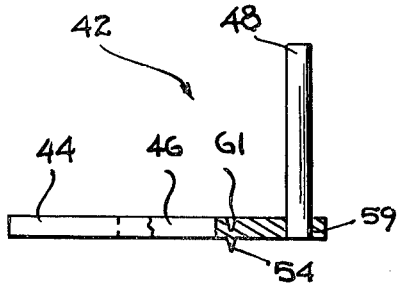
Figure 7:
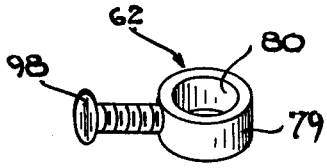
Figure 8A:
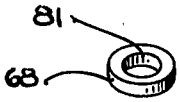
Figure 8:
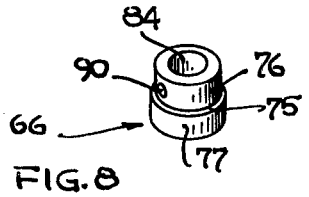
Figure 9:
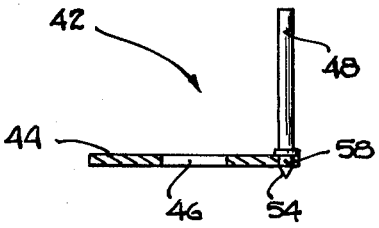
Figure 12:
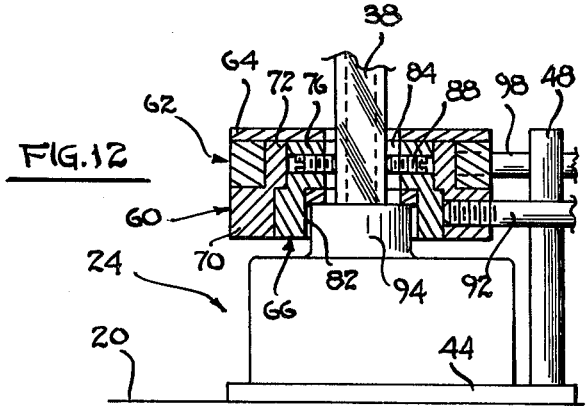
Figure 10:
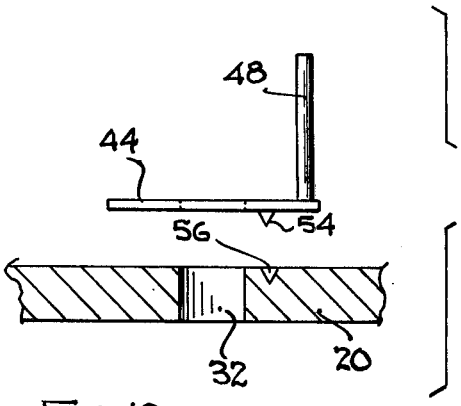
Figure 13:
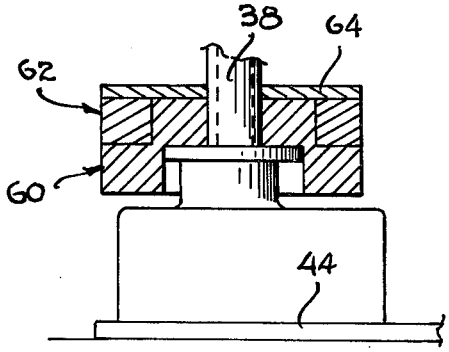

Having thus described the invention in general terms, reference will now be made to the accompanying drawings in which:

FIG. 1 is a perspective view, partially broken away, of a portion of stringed musical instrument embodying the device of the present invention;

FIG. 2 is a top-plan view of the device of FIG. 1;

FIG. 3 is a vertical sectional view substantially taken along line 3—3 of FIG. 1;

FIG. 4 is an exploded perspective view showing the components of the device of the present invention which permits the limiting of pitch change of stringed musical instruments;

FIG. 5 is a vertical sectional view showing the assembled relationship of a lower ring, an upper ring and adapter cylinder along with an insert along with a limit stop means in accordance with the present invention;

FIG. 6 is a perspective view of an upper ring constructed in accordance with and embodying the present invention;

FIG. 7 is a perspective view of a lower ring constructed in accordance with and embodying the present invention;

FIG. 8 is a perspective view of an adapter cylinder forming part of and embodying the present invention;

FIG. 8A is a perspective view of an insert which may be used with the adapter cylinder of FIG. 8;

FIG. 9 is a vertical sectional view showing a part of a limit stop means in accordance with and embodying the present invention;

FIG. 10 is a vertical sectional view showing a part of an alternate form of limit stop means used in accordance with and embodying the present invention;

FIG. 11 is yet a vertical sectional view of another form of alternate limit stop means used in accordance with and embodying the present invention;

FIG. 12 is a vertical sectional view showing the assembly of the present invention, somewhat similar to FIG. 3, and shown as forming part of a musical instrument without the adapter cylinder insert; and FIG. 13 is a vertical sectional view showing the assembly of the present invention, somewhat similar to FIG. 3, and shown as forming a part of the musical instrument without the adapter cylinder or the insert used therewith.

DETAILED DESCRIPTION OF PREFERRED EMBODIMENTS

Referring now in more detail and by reference characters to the drawings which illustrate preferred embodiments of the present invention, A designates a portion of a stringed musical instrument having an instrument head 20 as illustrated in FIG. 1 of the drawings. In this case, the stringed musical instruments could be any of a number of stringed musical instruments, as for example, violins, violas, cellos, guitars, banjos and the like.

A conventional stringed musical instrument can be modified by an assembly in accordance with the present invention in order to enable the user to change the pitch of the particular string by turning the tuning keys until a proper limit stop (hereinafter described) is contacted. In like manner, a stringed musical instrument can be constructed in accordance with this invention in order to enable the change of pitch as just described and as described in more detail hereinafter.

Rotatably mounted within and extending through the instrument head 20 is a tuning key rod 22 (often referred to as a "string pin") forming part of a conventional tuning key mechanism 24. A musical instrument cord or so-called "string" 28 is connected at one end to the string pin 22 and at the other end to the tail piece of the musical instrument in a conventional manner. The tension in the string 28, and therefore the pitch of the string, is controlled by rotation of the string pin 22 through the action of the tuning key mechanism 24, thereby causing the string 28 to wind onto or unwind from the string pin 22.

The string pin 22 on the tuning key mechanism 24 extends through an aperture 32 in the head 20, and the tuning key mechanism 24 is secured thereto by means of a washer 34 and a lock nut 36. The tuning key mechanism 24 is conventionally provided with an outwardly extending tuning knob shaft 38 retained by a friction washer 39. A tuning knob 40 is secured to the upper end of the shaft 38 by means of a screw 41 or like fastener.

The assembly of the invention includes a limit stop mechanism 42 comprised of a cylindrical disc 44 having an aperture 46 to receive the string pin 22 and an upstanding post 48 which serves as a "limit stop" often referred to as a "limit stop post". In like manner, the assembly includes a flexible washer 50 disposed on the upper surface of the disc 44 and which also inhibits rotation. This washer 50 is similarly provided with an aperture 52 aligned with the aperture 46 and the aperture 32 in order to receive the string pin 22. Thus, when the tuning key mechanism 24 is affixed to the instrument head, the limit stop mechanism 42 and the flexible washer 50 will be disposed beneath the head portion of the tuning key mechanism 24 and rigidly retained on the instrument head 20. Thus, when pressure is applied to the washer 50 by securement of the tuning key mechanism 24, the assembly is prevented from rotating when rotational force is applied to the tuning key shaft 38.

The limit stop mechanism 42 is also provided with a downwardly struck pointed protrusion 54 which can dig into the wood or other material from which the stringed instrument head 20 is formed, thereby causing a recess 56 to accommodate the protrusion 54. In some cases, the head of the tuning key mechanism 24 may be provided with an anti-rotation protrusion 55, generally in the form of a pin, which forms the recess 56 and, in this case, the protrusion 54 could be located so as to fit within the recess 56. In this way, the limit stop mechanism 42 is prevented from rotating with respect to the instrument head 20 during tuning of the tuning key 24.

The flexible washer 50 is used in conjunction with tuning key mechanisms which have two or more protrusions or so-called "dimples" located on their underside to prevent rotation of the mechanism by normally digging into the head 20 of the instrument. The flexible washer 50 provides a soft, somewhat resilient surface for the tuning key mechanism dimples to "bite" into when the tuning key mechanism is mounted on the limit stop 42.

FIG. 9 shows one embodiment of the limit stop mechanism 42 wherein the post 48 extends through an aperture 58 formed within the disc 44 and which post is provided at its lower end with a pointed protrusion 54. In this case, the post 48 can be rigidly secured within the aperture 58 by any conventional means.

FIG. 10 shows an additional embodiment of the limit stop mechanism 42 in which the protrusion 54 is located on the under side of the plate 44 in a position other than in registration with the post 48. In this case, it can be observed that the protrusion 54 would coact and engage a recess 56 properly positioned with respect to the protrusion 54 in the instrument head 20.

FIG. 11 illustrates a further modified form of limit stop mechanism 42 wherein the post 48 is secured within a recess 59 formed in the disc 44. In this case, the protrusion 54 is shown located on the underside of the disc 44 other than immediately beneath the post 48. In addition, a recess 61 is formed on the upper surface of the disc 44 in marginal registration with the protrusion or dimple 55. In this embodiment, the protrusion and recess could be formed simultaneously in a metal stamping operation.

The assembly of the present invention is uniquely adapted for use on several different types of tuning pegs, as for example tuning pegs with tuning shafts, e.g. the shaft 38, which is circular, or otherwise with tuning shafts which are non-circular. For this purpose, the assembly of the present invention further comprises an improved upper ring device 60, often referred to as an "upper annular body", or upper "cylindrically shaped body", a lower ring device 62 often referred to as a "lower annular body" or a lower "cylindrically shaped body", and an end washer 64. In addition, the assembly of the present invention provides an improved adapter cylinder 66, often referred to as an inner annular body, and adapter insert 68, all of which are illustrated in aligned relationship for assembly in FIG. 4 of the drawings.

It can be observed that while the tuning key mechanism 24 is illustrated in FIG. 1 as being located on the upper side of the instrument head 20, the tuning key mechanism may also be located on the lower side of the instrument when played or on transverse side walls thereof. Thus, FIG. 1 can be considered to show the instrument in a normal vertical direction. Moreover, the ring shaft 38 is in a normal vertical direction. Moreover, the ring device 60 is referred to as an "upper ring" inasmuch as the tuning key pegs are located on the underside of the stringed musical instrument and thus the ring device 60 would be the uppermost of the ring devices in this configuration.

The upper ring 60 device includes a cylindrically shaped ring 70 having an integrally formed diametrically reduced, upwardly extending cylindrically shaped boss 72, in the manner as illustrated in FIG. 6 of the drawings. Moreover, the boss 72 is internally provided with an aperture 74 in order to accommodate a diametrically reduced upper extension 76, often referred to as a second cylindrical body section, on the adapter cylinder 66. In addition, the upper ring device 60 is provided with a counter bore 78 in order to accommodate a cylindrically shaped outer ring 77 often referred to as a first cylindrical body section, forming part of the adapter cylinder 66. An annular shoulder 75 is formed on the upper surface of the ring 77. In this way, the entire adapter cylinder 66 can fit within the upper ring device 60, in the manner as more fully illustrated in FIG. 5 of the drawings.

The lower ring device 62 is provided with a cylindrically shaped ring 79 having a central circular aperture 80 which is adapted to rotatably fit over the upwardly extended boss 72 on the upper ring device 60, also in the manner as illustrated in FIG. 5 of the drawings.

The axial dimension of the adapter cylinder 66 is the same as the axial dimension of the upper ring device 60. In addition, the adapter cylinder 66 is counter-bored to provide a cylindrically shaped recess 82 in order to accommodate the insert 68 such that the insert 68 can be removably disposed within the recess 82. The cylinder insert 68 is more fully illustrated in FIG. 8A of the drawings and comprises a flat washer-like disc having a central bore 81 extending axially therethrough of such diameter to accommodate the turning knob shaft 38.

The extension 76 of the adapter cylinder 66 is provided with a diametrally reduced aperture 84 with an interior cross section of such size so that the adapter cylinder 66 will fit over the tuning key shaft 38 of non-circular cross-section.

The adapter cylinder 66 is constructed of suitable thickness and rigidity to withstand forces exerted on it when the upper ring device 60 is locked into place. In addition, the thickness of the extension 76 is sufficient so that locking screws 88 (FIG. 12) will extend for several turns through a pair of threaded holes 90 on diametrally opposite sides of the extension 76. In this case, it should be observed that the screws 88 must have such length so that when the adapter cylinder 66 is locked into place, the heads of the screws 88 do not protrude beyond the outer diameter of the extension 76. The aperture 84 is circular as illustrated, but could be provided with a pair of opposed flat walls possibly omitting the need for the screws 88.

The adapter cylinder 66 is used only when the tuning key shaft 38 is non-circular in cross-section or otherwise when the portion of the shaft 38 over which the upper ring device 60 would be located is non-circular in cross-section. The adapter cylinder, in this case, provides an axis for rotation of the upper ring 60 and a bearing surface for an upper ring thumbscrew 92 which is threadedly retained in the upper ring 70, when such an axis and surface are not available on the tuning key shaft 38.

In accordance with the present invention, the adapter cylinder and insert also permit the assembly to be used with a tuning key device which have neck portions thereon and such devices which do not have neck portions along with turning key shafts which may be either circular or non-circular. The recess 82 allows the adapter cylinder to slip down over the neck 94 of a tuning peg, in the manner as illustrated in FIG. 12 of the drawings and also provides the assembly with a very low profile. In this way, the assembly also allows the use of the original tuning knob screw 41.

The insert 68 is disposed within the recess 82 of the adapter cylinder when the tuning peg is not provided with a neck, in the manner as illustrated in FIG. 3 of the drawings. In like manner, FIG. 13 of the drawings illustrates the use of the upper and lower rings and other portions of the assembly without the adapter cylinder 66 or the insert 68. The complete assembly of the lower ring device and the upper ring along with the adapter cylinder and insert is more fully illustrated in FIG. 5 of the drawings. It can be observed that the upper ring device 60 and the lower ring device 62 along with the adapter cylinder 66 can be assembled in a small compact unit. Thus, an upper flat wall surface of the lower ring device 62 and an upper flat surface of the boss 72 on the upper ring device 60 along with an upper surface on the extension of the adapter cylinder 66 lie in a common horizontal plane. The lower surface of the insert 68, the lower flat surface of the adapter cylinder 66 and the lower flat surface of the upper ring device also lie in a common horizontal plane in the assembled relationship.

The extension 76 on the adapter cylinder and the shoulder 75 maintain the upper ring device 60 in position on the adapter cylinder 66 and limits the downward movement of the upper ring device. Moreover, the counter-bore 78 and the aperture 74 in the upper ring device works in conjunction with the adapter cylinder 66 to maintain the relative positions of the adapter cylinder 66 and the upper ring device 60.

The counter-bore 78 in the upper ring device 60 is more fully illustrated in FIG. 4 of the drawings. The counter-bore 78 in the boss 72 permits the ring device 60 to be rotatably mounted on the adapter cylinder 66 or otherwise on a circular tuning key shaft 38. An annular shoulder 96 is formed around the boss 72 where it extends upwardly from the ring 70 and the shoulder 96, along with the outer surface of the boss 72, provides a mounting axis for the lower ring device 62. The outer diameter of the ring 70 is of such thickness and rigidity to withstand forces exerted on it when the lower ring device 62 is locked in place. In like manner, the outer diameter of the boss 72 is essentially the same as the inner diameter of the lower ring 79 so that the lower ring device may be rotatably mounted on the upper ring device and in this way a cylinder of constant outer diameter results as shown in FIGS. 1, 3 and 5.

The lower ring device 62 is more fully illustrated in FIG. 7 of the drawings and the diameter of the aperture 80 is such that the lower ring may be rotatably mounted on the boss 72 of the upper ring. Again, the outer wall of the ring 79 is constructed of suitable thickness in order to provide a threaded aperture (not shown) to receive a lower ring thumbscrew 98. The threaded aperture which receives the thumbscrew 98 extends radially through the wall of the ring 79 and the thumbscrew 98 locks the lower ring device 62 to the upper ring device 60. Thus, the axial dimension of the lower ring 79 is the same as the axial dimension of the boss 72 on the upper ring device 60.

In operation, when the limit stop device 42 is mounted on the head of the instrument, as illustrated in FIG. 1, or FIG. 2 and FIG. 3, in such position that the upper ring thumbscrew 92 and the lower ring thumbscrew 98 may come into contact with the limit post 48 and thereby limit the motion of the tuning key shaft 38. When the adapter cylinder 66 is employed, it is rigidly mounted on the tuning key shaft 38 and is locked in place with the set screws 88. In this arrangement, the upper ring device 60 is rotatably mounted on the adapter cylinder 66 and the lower ring device 62 is rotatably mounted on the upper ring device 60.

In accordance with this arrangement, the range of pitch change is determined by the relative positions of the upper ring thumbscrew 92 with respect to the lower ring thumbscrew 98 as illustrated in FIG. 2 of the drawings. The range is set by tuning the string 28 to the low note of the range, locking the upper ring device 60 to the adapter cylinder 66 in such a position that the upper ring thumbscrew 92 is in contact with the limit stop post 48. The string 28 is then tuned to the upper note of the range and the lower ring device 62 is located in a position such that the lower ring thumbscrew 98 is in contact with the limit stop post 48.

To illustrate the use of the device, assume that the string 28 is normally tuned to the high note of the range, and that the user wishes to produce a sliding effect by adjusting the pitch to the low note of the range. With the string 28 tuned to the high note, the lower ring thumbscrew 98 is in contact with the limit stop post 48. While playing the instrument, the user plucks the string 28 in the conventional manner, and then rotates the tuning key 24 until the motion is stopped by the upper ring thumbscrew 92 contacting the limit stop post 48, thus lower the pitch of the string 28 to the lower note of the range.

Should it be necessary to tune the string so that it has the proper pitch in relation to the other strings on the instrument, it is only necessary to loosen the upper ring thumbscrew 92, retune the string 28 to the proper pitch, and then retighten the upper ring thumbscrew 92 so that the lower ring thumbscrew 98 is again in contact with the limit stop post 48. This procedure does not change the relative position of the upper ring thumbscrew 92 with respect to the lower ring thumbscrew 98, and therefore the range of pitch change remains the same.

It can be observed that the assembly of the present invention can be used in arrangements where it actually forms part of the musical instrument and can be constructed into the musical instrument. Moreover, in accordance with this arrangement, a low profile of the entire assembly is provided and permits the use of the original tuning knob screw. The adapter cylinder 66 permits the use of the assembly with tuning pegs which do not have a neck portion thereon. In addition, the adapter cylinder without the insert permits the use of the adapter cylinder where the tuning peg is provided with a neck portion. Moreover, the upper ring device works in conjunction with the adapter cylinder to maintain the relative positions of the adapter cylinder and the upper ring device. Thus, in those cases in which the tuning peg is provided with a round shaft, the upper ring device can mount directly on the tuning peg shaft, thereby eliminating the adapter cylinder and the insert and greatly simplifying the construction and installation of the assembly.

Thus, there has been illustrated and described a unique and novel assembly for limiting pitch change in stringed musical instruments and which can be used in conjunction with a wide variety of stringed musical instruments. Thus, this assembly fulfills all of the objects and advantages sought for. It should be understood that many changes, modifications, variations and other uses and applications will be apparent to those skilled in the art after considering this specification and the accompanying drawings. Therefore, any and all such changes, modifications, variations and other uses and applications which do not depart from the spirit and scope of the invention are deemed to be covered by the invention.

Having thus described our invention, what we desire to claim and secure by Letters Patent is:

1. In a tuning key for stringed musical instruments in combination, an instrument body, a tuning key peg having a shaft rotatably mounted on said instrument body, said tuning key head also having an enlarged head with a protrusion thereon normally adapted to engage body and having a plate and an outwardly extending limit stop element, a protrusion on a surface of said limit stop plate to engage said instrument body and lock said limit plate to said instrument body to prevent rotational movement of said limit stop means with respect to said instrument body, a flexible washer located between said enlarged head and said limit stop plate and having a resilient surface to receive the protrusion on said enlarged head to thereby lock said tuning key to said limit stop means, an adapter cylinder provided for rigid mounting on the rotatable shaft of said tuning key when said shaft has a particular one of certain cross-sectional shapes and which can be omitted when said shaft has another cross-sectional shape, said adapter cylinder having a first cylindrical body section and a second cylindrical body section of reduced diameter joined to extending from said first cylindrical body section, annular shoulder means on said first cylindrical body section surrounding said second cylindrical body section at the joinder of said two body sections, an upper ring provided for rotatable disposition on said adapter cylinder and having a thumb screw to lock said upper ring to said adapter cylinder and contact said limit stop, said upper ring also being adapted for rotatable disposition on said shaft when said adapter cylinder is omitted, said upper ring having a ring portion with a first aperture to receive said first body section and a diametrally reduced extension with a second diametrally reduced aperture to receive said second body section, a shoulder on said upper ring formed between said ring portion and said diametrally reduced extension, said first aperture having a size and shape approximately equal to the size and shape of first cylindrical body section and said second aperture having a size and shape approximately equal to the size and shape of said second body section, said adapter cylinder and upper ring having substantially the same axial dimension, and a lower ring rotatably mounted on said diametrally reduced extension of said upper ring and having a thumb screw to lock said lower ring to said upper ring and contact said limit stop, said upper ring having a first end on said ring portion and an opposite second end on said diametrally reduced extension, said adapter cylinder having a first end on said first cylindrical body section and a second opposite end on said second cylindrical body section and said adapter cylinder having a recess in the first body section and at the first end thereof, said upper ring and adapter cylinder having substantially the same axial dimension, said lower ring having a first end engageable with the shoulder on said upper ring and having a second end, the second ends of said upper and lower rings and adapter cylinder being generally flush and the first ends of said adapter cylinder and upper ring being generally flush when in the assembled relationship, and insert means provided for removable insertion into said recess to accommodate a tuning key peg without a neck portion thereon.

2. The combination of claim 1 further characterized in that said protrusion is located on one surface of said plate beneath said stop element on the opposite surface of said plate.

* * * * *